US006732747B2

(12) United States Patent
Wise

(10) Patent No.: US 6,732,747 B2
(45) Date of Patent: May 11, 2004

(54) COMPOSITION AND METHOD FOR CLEANING AND DISINFECTING A GARBAGE DISPOSAL

(76) Inventor: William S. Wise, 10921 Reed Hartman Hwy., Suite 316, Cincinnati, OH (US) 45242

( * ) Notice: Subject to any disclaimer, the term of this patent is extended or adjusted under 35 U.S.C. 154(b) by 0 days.

(21) Appl. No.: 10/413,783

(22) Filed: Apr. 15, 2003

(65) Prior Publication Data

US 2003/0207779 A1 Nov. 6, 2003

Related U.S. Application Data

(63) Continuation of application No. 09/769,550, filed on Jan. 25, 2001, now Pat. No. 6,554,007, which is a continuation-in-part of application No. 09/448,989, filed on Nov. 24, 1999, now abandoned.

(51) Int. Cl.[7] ..... B08B 9/027; B08B 3/04; C11D 1/00; C11D 3/24; C11D 9/50

(52) U.S. Cl. ..... 134/22.14; 134/22.19; 134/25.2; 134/25.3; 134/39; 134/40; 134/42; 510/194; 510/195; 510/199; 510/367; 510/372; 510/375; 510/384; 510/391; 510/395; 510/504

(58) Field of Search ..... 134/22.14, 22.19, 134/25.2, 25.3, 39, 40, 42; 510/194, 195, 199, 367, 372, 375, 384, 391, 395, 504

(56) References Cited

U.S. PATENT DOCUMENTS

| | | | | |
|---|---|---|---|---|
| 4,480,795 A | | 11/1984 | Pellegrino | |
| 4,619,710 A | * | 10/1986 | Kuenn et al. | 134/22.17 |
| 4,852,813 A | | 8/1989 | Brackett | |
| 5,230,823 A | | 7/1993 | Wise et al. | |
| 5,233,087 A | | 8/1993 | Cripe | |
| 5,269,974 A | | 12/1993 | Ofosu-Assante | |
| 5,310,096 A | | 5/1994 | Rogers et al. | |
| 5,378,409 A | | 1/1995 | Ofosu-Assante | |
| 5,417,893 A | | 5/1995 | Ofosu-Assante | |
| 5,545,354 A | | 8/1996 | Ofosu-Assante | |
| 5,599,400 A | | 2/1997 | Mao et al. | |
| 5,739,092 A | | 4/1998 | Ofosu-Assante | |
| 5,952,278 A | | 9/1999 | Mao et al. | |
| 6,004,922 A | | 12/1999 | Watson et al. | |
| 6,013,615 A | | 1/2000 | Zhou et al. | |
| 6,016,980 A | | 1/2000 | Hill | |
| 6,090,768 A | | 7/2000 | Delaney et al. | |
| 6,121,032 A | * | 9/2000 | Cooney, Jr. | 435/198 |
| 6,350,607 B1 | | 2/2002 | Cooney, Jr. | |
| 6,554,007 B2 | * | 4/2003 | Wise | 134/22.14 |

* cited by examiner

*Primary Examiner*—Brian P. Mruk
(74) *Attorney, Agent, or Firm*—Hasse Guttag & Nesbitt LLC; Eric W. Guttag

(57) ABSTRACT

An improved composition and method for cleaning and disinfecting a garbage disposal that does not require aerosol propellants or carbon dioxide gas generating reaction systems. The composition comprises a suds stabilizing surfactant and a disinfecting agent, plus other optional ingredients such as additional detergent surfactant and scouring agents. In the method of cleaning and disinfecting, a flow of water is provided to the garbage disposal and the composition is then added while the garbage disposal is turned on. The mechanical action of the garbage disposal grinder blades rapidly mixes the composition with water to create suds and disperse the suds around the entire interior chamber, thus cleansing and disinfecting the garbage disposal. After the suds are generated, the flow of water is discontinued, with the garbage disposal being turned off within about 1 minute after the flow of water is discontinued.

20 Claims, No Drawings

COMPOSITION AND METHOD FOR CLEANING AND DISINFECTING A GARBAGE DISPOSAL

CROSS-REFERENCE TO RELATED APPLICATION

This application is a continuation of U.S. application Ser. No. 09/769,550, filed Jan. 25, 2001, now U.S. Pat. No. 6,554,007, which is a continuation-in-part of U.S. application Ser. No. 09/448,989, filed Nov. 24, 1999 now abandoned, which is incorporated by reference.

TECHNICAL FIELD OF INVENTION

The present invention relates to an improved composition and method for cleaning and disinfecting a garbage disposal. The present invention particularly relates to an improved composition and method where the cleansing and disinfecting action occurs due to suds generated as the composition and faucet water are mixed and churned together by the grinding action of the garbage disposal.

BACKGROUND OF THE INVENTION

It is common knowledge that the interior chambers of garbage disposals are fertile grounds for malodors. The grinding action of disposals throw food particles onto the walls of the interior chamber and the food decomposes in the warm, wet environment. The decomposing food inside the disposal is a breeding ground for pathogenic microorganisms, thus creating a foul smelling garbage disposal.

Prior devices and methods for combating such malodors in garbage disposals have been suggested, but they have not been successful in providing an inexpensive solution that is easy to use and solves the malodor problems. For example, U.S. Pat. No. 4,852,813 (Brackett), issued Aug. 1, 1989, discloses a device which, upon activation of the garbage disposal unit, is propelled against the wall of the interior chamber. This propelled device is not very effective because it can only clean the surfaces it touches as it ricochets off the chamber walls. See also U.S. Pat. No. 4,480,795 (Pellegrino), issued Nov. 6, 1984, which discloses cleaning waste disposal units by rapidly propelling highly resilient bodies that bounce back and forth within the waste disposal unit to provide an abrading or scouring action.

Another example is U.S. Pat. No. 5,310,096 (Rogers), issued Mar. 10, 1994, which discloses a device that includes an aerosol container comprised of foam material containing an aerosol propellant, a disinfectant, a deodorizing agent and a cleaning agent. This aerosol container is removably attached to an adaptor which, after the device has been placed within the opening of the garbage disposal and pressure has been applied to the adaptor, will cause the foam material to flow from the aerosol container into the interior chamber of the garbage disposal unit. The foam must then be left in the garbage disposal for 10–15 minutes before water is run in and/or the disposal is run, thus rendering the kitchen sink useless for a relatively long period of time. Because the foaming of the composition occurs as it is dispensed from the aerosol can, the Rogers device also lacks the mechanical action of water to loosen dried food off the sides of the interior chamber, thus significantly minimizing the ability of the foam to actually clean and disinfect the interior chamber. Other disadvantages of the Rogers' device include the expense of making the aerosol container, especially with a custom adapter/applicator, and the difficulty for the average consumer in using such a device, especially since the consumer must shake the aerosol container before use and then must clean the adapter/applicator after each use.

Yet another example is U.S. Pat. No. 4,619,710 (Kuenn et al), issued Oct. 28, 1986, which discloses a composition for cleaning a garbage disposal that contains an acid, an alkali carbonate, one or more surfactants, as well as other optional ingredients such as germicides, colors, fragrances, and abrasives. The acid and the alkali carbonate react with a small amount of water in the disposal unit to release carbon dioxide gas which acts with the surfactants and the grinding action of the disposal to build a heavy foam that expands to fill the interior chamber of the unit and emerges through the baffle into the sink. The cycle required for effective cleaning with the Kuenn et al composition is again relatively long, i.e., approximately 3 to 5 minutes. Also, the Kuenn et al composition appears to rely primarily on the carbon dioxide gas generated by the reaction of the acid and the alkali carbonate to generate the heavy foam. Indeed, the small amount of water used in generating the carbon dioxide gas is insufficient to provide effective cleaning of the garbage disposal unit.

Accordingly, it would be desirable to provide a garbage disposal cleaning method and composition that: (1) effectively cleans and disinfects the interior chamber of garbage disposals by utilizing the mechanical grinding action of the garbage disposal to rapidly mix the composition with water to generate suds and disperse the suds around the entire interior chamber, thus cleaning and disinfecting the garbage disposal; (2) is inexpensive and ready to use for the consumer (no pre-work or cleanup); (3) does not require aerosol propellants or carbon dioxide gas generation to create the foam; and (4) has a relatively short cleaning and disinfecting cycle so that the garbage disposal and sink area will be ready to use relatively quickly after the completion of the physical steps of cleaning and disinfecting.

SUMMARY OF THE INVENTION

The present invention relates to an improved composition and method for cleaning and disinfecting a garbage disposal that utilizes the mechanical grinding action of the disposal to mix and churn the composition in the presence of water to generate suds that provide an effective cleansing and disinfecting action. The composition is preferably substantially free of aerosol propellants and carbon dioxide gas generating reaction systems, and comprises:

a) a suds stabilizing amount of a suds stabilizing surfactant selected for the group consisting of betaines, ethylene oxide condensates, fatty acid amides, amine oxide semi polar nonionics, sultaines, cationic surfactants and mixtures thereof;

b) a disinfecting amount of a disinfecting agent selected from the group consisting of quaternary ammonium compounds, halogenated compounds, phenolics, alcohols, aldehydes, oxidizing agents and mixtures thereof;

c) other optional ingredients that can include:

1) from about 1% to about 95% of an additional surfactant selected from the group consisting of anionic surfactants, nonionic surfactants, amphoteric surfactants, zwitterionic surfactants and mixtures thereof;

2) from about 0.5% to about 50% of a scouring agent.

The improved method of the present invention comprises the step of adding a cleansing and disinfecting amount of the composition of the present invention to the garbage disposal in the presence of water and while the grinding action of the garbage disposal is activated to mix the composition and water so that sufficient suds are generated to provide cleansing and disinfecting of the disposal. A preferred embodiment of the improved method of the present invention comprises the steps of:

(1) providing a flow of water to the garbage disposal (2) adding a cleansing and disinfecting amount of the composition of the present invention to the garbage disposal in the presence of water and while the grinding action of the garbage disposal is activated to mix the composition and water so that sufficient suds are generated to provide cleansing and disinfecting of the disposal;

(3) discontinuing the flow of water to the garbage disposal after the suds are generated; and (4) deactivating (stopping) the grinding action of the garbage disposal within about 1 minute after the flow of water is discontinued.

The improved composition and method of the present invention effectively cleans and disinfects the interior chamber of garbage disposals by utilizing the mechanical grinding action of the garbage disposal to rapidly mix the composition with the water to create suds and disperse the suds around the entire interior chamber of the disposal, thus effectively cleansing and disinfecting the garbage disposal. The improved composition of the present invention is relatively inexpensive for the consumer and is ready to use (i.e., no pre-work or cleanup required). The suds generated by the improved composition and method of the present invention are sufficiently effective to cleanse and disinfect the garbage disposal so that aerosol propellants or carbon dioxide gas generation is not required. The cleaning and disinfecting cycle is relatively short so that the garbage disposal and sink are ready to use quickly after the method of the present invention has been carried out.

DETAILED DESCRIPTION OF THE INVENTION

1. Definitions

As used herein, the term "comprising" means various components and steps can be conjointly employed in the present invention. Accordingly, the term "comprising" encompasses the more restrictive terms "consisting essentially of" and "consisting of."

All amounts, parts, ratios and percentages used herein are by weight unless otherwise specified.

2. Composition

The improved composition for cleaning and disinfecting a garbage disposal according to the present invention can be in any suitable form (e.g., a liquid, gel, tablet or powder). The improved composition of the present invention is a also preferably substantially free of (i.e., less than about 1% and preferably less than about 0.5%) aerosol propellants of the type disclosed in U.S. Pat. No. 5,310,096 (Rogers), issued Mar. 10, 1994 and carbon dioxide gas generating reaction systems (e.g., acid and alkali carbonate) of the type disclosed U.S. Pat. No. 4,619,710 (Kuenn et al), issued Oct. 28, 1986. It has been found that the improved composition of the present invention generates sufficient suds to provide an effective cleansing and disinfecting action when combined with water and mixed by the grinding action of the garbage disposal without the need of additional foaming components, in particular, aerosol propellants and carbon dioxide gas generating reaction systems.

The improved compositions of the present invention comprise a suds stabilizing amount of a suds stabilizing surfactant (also referred to herein interchangeably as a "suds booster"). Suitable amounts of suds stabilizing surfactants can be in the range of from about 0.1% to about 60% of the composition, more typically in the range of from 0.5% to about 45%, and preferably in the range of from about 1% to about 30%.

Suds stabilizing surfactants that are operable in the compositions of the present invention include betaines (e.g., complex betaines), ethylene oxide condensates, fatty acid amides, amine oxide semi polar nonionics, sultaines, cationic surfactants, and mixtures thereof. See, for example, U.S. Pat. No. 5,952,278 (Mao et al), issued Sep. 14, 1999, which is incorporated by reference.

Suitable betaine detergent surfactants for use as suds stabilizing surfactants or suds boosters herein have the general formula:

$$R—N^+(R^1)_2—R^2COO^-$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with the benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms. Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate. Other suitable amidoalkylbetaines are disclosed in U.S. Pat. Nos. 3,950,417; 4,137,191; and 4,375,421; and British Patent Specification 2,103,236, all of which are incorporated herein by reference.

Betaines suitable for use as suds stabilizing surfactants and suds boosters herein also include the complex betaines. Suitable complex betaines have the formula:

$$R—(A)_n—[\underset{\underset{B}{|}}{N}—(CHR^1)_x]_y—\underset{\underset{B}{|}}{N}—Q$$

wherein R is a hydrocarbon group having from 7 to 22 carbon atoms, A is the group (C(O), n is 0 or 1, $R^1$ is hydrogen or a lower alkyl group, x is 2 or 3, y is an integer of 0 to 4, Q is the group —$R^2$COOM wherein $R^2$ is an alkylene group having from 1 to 6 carbon atoms and M is hydrogen or an ion from the groups alkali metals, alkaline earth metals, ammonium and substituted ammonium and B is hydrogen or a group Q as defined.

Ethylene oxide condensates suitable for use as suds stabilizing surfactants and suds boosters herein are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements. Examples of such ethylene oxide condensates suitable as suds stabilizers or suds boosters are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers or suds boosters, the ethylene oxide being present in amounts of from about 8 moles to about 30, preferably from about 8 to about 14 moles of ethylene oxide per mole of alcohol.

Fatty acid amide surfactants suitable for use as suds stabilizing surfactants and suds boosters herein include the ammonia, monoethanol, and diethanol amides of fatty acids having an acyl moiety containing from about 8 to about 18 carbon atoms and represented by the general formula:

$$R_1—CO—N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dodecyl fatty acid amide. These acyl moieties can be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants suitable for use as suds stabilizing surfactants and suds boosters herein comprise compounds and mixtures of compounds having the formula:

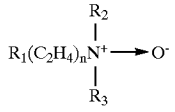

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

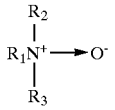

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), which is incorporated by reference.

Sultaines suitable for use as suds stabilizing agents and suds boosters herein are those compounds having the formula: $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12-14}$ amido propyl ammonio-2-hydroxypropyl sultaine, $C_{12-14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

Cationic surfactants suitable for use as suds stabilizing surfactants and suds boosters herein include the cationic quaternary ammonium surfactants of the formula:

$$R^1(OR^2)_yR^3(OR^2)y]_2R^4N^+X^-$$

or amine surfactants of the formula:

$$R^1(OR^2)_yR^3(OR^2)y]_2R^4N$$

wherein $R^1$ is an alkyl or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R_3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion. Preferred are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethylammonium salts, $C_{8-16}$ alkyl di(hydroxyethyl) methylammonium salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of these, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

The suds stabilizing agents or suds boosters used in the composition of the present invention can contain any one or a mixture of the suds stabilizers/boosters listed above.

The compositions of the present invention further comprise a disinfecting amount of a disinfecting agent, i.e., an agent that disinfects by destroying, neutralizing or inhibiting the growth of pathogenic microorganisms. Suitable amounts of disinfecting agent can be in the range of from about 0.01% to about 50%, preferably from about 0.08% to about 40%, more preferably from about 0.1% to about 25%. Suitable disinfecting agents include quaternary ammonium compounds, halogenated compounds, phenolics, alcohols, aldehydes, oxidizing agents and mixtures thereof.

Suitable quaternary ammonium disinfectant for use herein include dioctyl, octyldecyl and didecyl dimethyl ammonium chloride, n-alkyl ($C_{12}$ to $C_{18}$) dimethyl ethyl benzyl ammonium chlorides, n-alkyl dimethyl benzyl ammonium chlorides wherein the alkyl is higher alkyl of from 10 to about 18 carbon atoms, acidified quaternary ammonium compounds (quat+phosphoric acid) and mixtures thereof.

Suitable phenolic disinfectants for use herein include o-phenylphenol, o-benzyl-p-chlorophenol and mixtures thereof.

Suitable halogenated compound disinfectants for use herein include sodium hypochlorite (e.g. 0.75% NaOCl, 0.4 NaOH), sodium chlorite, chlorine dioxide, complex-bound iodine, titratable iodine and mixtures thereof. See also U.S. Pat. No. 4,619,710 (Kuenn et al), issued Oct. 28, 1986 (herein incorporated by reference), which discloses various halogenated compounds that are effective germicidal disinfecting agents.

Suitable alcohol disinfectants for use herein include isopropyl, ethyl alcohol and mixtures thereof.

Suitable aldehyde disinfectants for use herein include glutaraldehyde unactivated, glutaraldehyde activated and mixtures thereof.

Suitable oxidizing disinfectants for use herein include hydrogen peroxide, potassium permanganate and mixtures thereof.

The disinfectants used in the compositions of the present invention can contain any one or a mixture of the disinfectants listed above.

The compositions of this invention can also optionally, but preferably comprise from about 1% to about 95%, preferably from about 2% to about 75%, more preferably from about 5% to about 70% by weight of an additional detergent surfactant, i.e., surfactant above and beyond that of the suds stabilizing surfactant or suds booster. These surfactants contribute to sudsing and detergency of the composition of the present invention. These additional surfactants can be selected from the groups consisting of anionic surfactants, nonionic surfactants, cationic surfactants (e.g. tetralkyl ammonium halides); amphoteric surfactants, zwitterionic surfactants (e.g. derivatives of secondary and tertiary amines) and mixtures thereof.

Suitable anionic surfactants for use herein include the sodium salts of medium chain length (7–18 carbon) alkyl benzene sulfonates, paraffin sulfonates, disulfonates, alkylated diphenyl oxide disulfonates, alkyl sulfates or sulfonates, and alkyl ether sulfates such as sodium coconut alkyl sulfate, potassium coconut alkyl sulfate, potassium lauryl sulfate, sodium lauryl sulfate, sodium yellow fatty alcohol ether sulfates, tallow fatty ether sulfate, sodium dodecyl benzene sulfonate, sodium stearyl sulfate, sodium palmityl sulfate, sodium decyl sulfate, sodium myristyl sulfate, sodium dodecyl sulfate, potassium dodecyl benzene sulfonates, potassium stearyl sulfate, potassium palmityl sulfate, potassium decyl sulfate, potassium myristyl sulfate, and potassium dodecyl sulfate, taurates, sarcosinates, isethionates, alkyl beta-alanines, cycloimides, sulfated ethoxylated fatty alcohols, alpha-olefin sulfonates (AOS), and linear alkylbenzene sulfonates (LAS)

Suitable nonionic surfactants include products made from tall oil by reaction with ethylene oxide, such as polyethyleneoxide condensates of alkyl phenols, for example, nonyl phenol condensed with about 9.5 moles of ethylene oxide per mole of nonyl phenol, dodecylphenol condensed with about 12 moles of ethylene oxide per mole of phenol, dinonyl phenol condensed with about 15 moles of ethylene oxide per mole of phenol; and diisooctyl phenol condensed with about 15 moles of ethylene oxide per mole of phenol and commercially available under the trade names Igepal CO-630 (marketed by the GAF Corporation), and Triton X-45, X-114, X-100, and X-102 (all marketed by the Rohm & Haas Company); condensation products of aliphatic alcohols with ethylene oxide, for example, the condensation product of tallow fatty alcohol with about 25 moles of ethylene oxide per mole of alcohol, the condensation product of myristyl alcohol with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms) and commercially available under the trade names Tergitol 15-S-9 (marketed by Union Carbide Corporation), Neodol 45-9, Neodol 23-6.5, Neodol 45-7, and Neodol 45-4 (marketed by Shell Chemical Company), and Kyro EOB (marketed by The Proctor & Gamble Company); condensation products of ethylene oxide with a hydrophobic base formed by the condensation of propylene oxide with propylene glycol and commercially available under the trade name Pluronic (marketed by Wyandotte Chemical Corporation); condensation products of ethylene oxide with the product resulting from the reaction of propylene oxide and ethylenediamine and commercially available under the trade name Tetronic (marketed by Wyandotte Chemical Corporation). CO-630, marketed by the GAF Corporation;

The additional detergent surfactants used in the compositions of this invention can contain any one or a mixture of the surfactants listed above.

The compositions of present invention can also optionally, but preferably comprise from about 0.5% to about 50%, preferably from about 0.8% to about 25%, more preferably from about 1% to about 15% by weight of a scouring agent(s). The scouring agents are included in the compositions of the present invention to contribute to cleaning. Suitable scouring agents for use herein can be selected from the group consisting of silicates, (e.g., sodium silicates and zirconium silicates), quartz, pumice, pumicite, silica sand, calcium carbonate, calcium phosphate, diatomaceous earth, other suitable abrasive particles, as well as mixtures thereof.

Other optional ingredients that can be present in the compositions of the present invention include colors, malodor counteractants, fragrances, pH adjusters, thickeners (e.g., Carbopol), etc.

Some representative formulas for compositions according to the present invention are as follows:

FORMULAS 1–3

Formulas 1–3

| Ingredient | Amount | | |
|---|---|---|---|
| | Formula 1 | Formula 2 | Formula 3 |
| Dowfax 2A1 Surfactant (anionic surfactant) | 7% | 2.5% | 0.5% |
| Dowfax Detergent Surfactant (anionic surfactant) | 7% | 2.5% | 0.5% |
| Dowfax C10L Surfactant (anionic surfactant) | 7% | 2.5% | 0.5% |
| Dowfax 3B2 Surfactant (anionic surfactant) | 7% | 2.5% | 0.5% |
| Ammonyx LO (Lauramine Oxide) | 14% | 20% | 50% |
| Bleach (NaOCl) | 28% | 20% | 10% |
| Water | Balance | Balance | Balance |

FORMULA 4

Formula 4

| Ingredient | Amount |
|---|---|
| Colatrope Inc. (Sodium Alkonate) | 2–10% |
| Hostapur SAS 60 (Sodium $C_{14}$–$C_{17}$ Alkyl Sulfonate) | 2–10% |
| Ammonyx LO (Lauramine Oxide) | 5–60% |
| Bleach (NaOCl) | 10% |
| Soda Ash (pH 11–13) | 2% |
| Water | Balance |

3. Method

The above compositions are used according to the method of the present invention to eliminate the odors associated with garbage disposals by cleaning and disinfecting the interior chamber of the unit. In the method of the present invention, a cleansing and disinfecting amount of the composition of the present invention is added to the garbage disposal in the presence of water while the grinding action of the garbage disposal is activated to mix the composition and water. This generates sufficient suds in the garbage disposal to effectively cleanse and disinfect it.

A particularly preferred embodiment of this method comprises the following steps: (1) providing a flow of water to the garbage disposal; (2) adding a cleansing and disinfecting amount of the composition of the present invention to the garbage disposal while the grinding action of the garbage disposal is activated to mix the composition and water so that sufficient suds are generated to provide cleansing and disinfecting of the disposal; (3) discontinuing the flow of water to the garbage disposal after the suds are generated; and (4) deactivating (stopping) the grinding action of the garbage disposal within about 1 minute (e.g., immediately), preferably within about 30 seconds (e.g., typically within from about 3 to about 30 seconds), after the flow of water is discontinued. Typically this preferred method involves initially running water into the garbage disposal from the sink faucet. As soon as the water is running, the garbage disposal is turned on (activated) to provide a grinding and churning action, and then the composition is added to the garbage disposal. The grinding and churning action of the garbage disposal causes the composition and water to be mixed and combined together so as to generate and create suds. As soon as the suds are generated, the water from the faucet can then be shut off. After the water is shut off, the grinder grinding action of the garbage disposal can continue to mix and churn the composition and residual water and to further generate suds for a short period of time, at which point the grinding action is stopped by turning off the garbage disposal. At this point, the garbage disposal will have been effectively cleaned and disinfected.

In operation, the suds generated by the mixing of the improved composition of the present invention containing the suds stabilizing surfactants/suds boosters and disinfecting agents, with the water from the faucet due to the mechanical grinding action of the rotating grinder blades of the garbage disposal, provides an effective cleansing and disinfecting action for the disposal. In particular, the grinding action of these rotating grinder blades mix the improved composition of the present invention with the water to generate and create suds for cleaning and delivering the disinfectant to the entire interior chamber of the disposal. The suds stabilizing surfactant provides good cleaning properties, with the disinfectant being in contact with the entire surface of the interior chamber by means of the suds and thus destroys or inhibits the growth of the pathogenic microorganisms. The movement of the suds due to flying water and food debris caused by the grinding action of the rotating grinder blades of the garbage disposal creates an excellent cleaning environment and inhibits the growth of odor causing pathogenic microorganisms. With the inclusion of the optional ingredients such as additional surfactants and scouring agents, the improved composition of the present invention can provide added solubilization of and aid in the removal of greases, oils and other materials present in the disposal. The composition and method of the present invention also provides a highly reliable and economical product that can be easily used by the consumer to eliminate these unwanted odors in their disposals. The improved composition of the present invention is easy for the consumer to use (i.e., no pre or post work) and renders the sink area and garbage disposal ready to use relatively quickly after cleaning and disinfecting has been completed.

The method of the present invention can also be provided as a set of instructions that are written or printed on sheet of paper or on the packaging of an associated product containing the improved composition of the present invention. For example, the set of instructions can be written or printed on the outside of the package, or provided as a separate sheet that is attached to or inserted inside the package.

While the above description contains many specifications, those should not be construed as limitations of the scope of the present invention, but rather as an exemplification of preferred embodiments thereof.

What is claimed is:

1. A method for cleaning and disinfecting a garbage disposal, which comprises the step of adding a cleansing and disinfecting amount of a cleansing and disinfecting composition to the garbage disposal in the presence of water and while the grinding action of the garbage disposal is activated to mix the composition and water so that sufficient suds are generated to provide cleansing and disinfecting of the garbage disposal, the composition being substantially free of an aerosol propellant and a carbon dioxide gas generating reaction system and comprising:

a) a suds stabilizing amount of a suds stabilizing surfactant selected for the group consisting of betaines, ethylene oxide condensates, fatty acid amides, amine oxide semi polar nonionics, sultaines, cationic surfactants and mixtures thereof; and b) a disinfecting amount of a disinfecting agent selected from the group consisting of oxidizing agents and mixtures of oxidizing agents with a member selected from the group consisting of quaternary ammonium compounds, halogenated compounds, phenolics, alcohols, aldehydes, and mixtures thereof.

2. The method of claim 1 wherein the composition comprises from about 0.1% to about 60% of the suds stabilizing surfactant and from about 0.01% to about 50% of the disinfecting agent.

3. The method of claim 2 wherein the composition comprises from about 0.5% to about 45% of the suds stabilizing surfactant and from about 0.1% to about 25% of the disinfecting agent.

4. The method claim 2 wherein the suds stabilizing surfactant is an amine oxide semi polar nonionic.

5. The method of claim 4 wherein the disinfecting agent is selected from the group consisting of hydrogen peroxide, potassium permanganate and mixtures thereof.

6. The method of claim 2 wherein the composition further comprises from about 1% to about 95% of an additional detergent surfactant selected from the group consisting of anionic surfactants, nonionic surfactants, cationic surfactants, amphoteric surfactants, zwitterionic surfactants and mixtures thereof.

7. The method of claim 6 wherein the composition comprises from about 5% to about 70% of the additional detergent surfactant selected from the group consisting of anionic surfactants, nonionic surfactants and mixtures thereof.

8. The method of claim 7 wherein the composition further comprises from about 0.5% to about 50% by weight of a scouring agent.

9. The method of claim 8 wherein the composition comprises from about 1% to about 15% by weight of the scouring agent.

10. A product especially suitable for cleaning and disinfecting garbage disposals, and which comprises:

(A) a composition that is substantially free of an aerosol propellant and a carbon dioxide gas generating reaction system and which comprises:

(1) a suds stabilizing amount of a suds stabilizing surfactant selected from the group consisting of betaines, ethylene oxide condensates, fatty acid amides, amine oxide, amine oxide semi polar nonionics, sultaines, cationic surfactants and mixtures thereof; and (2) a disinfecting amount of a disinfecting agent selected from the group consisting of oxidizing agents and mixtures of oxidizing agents with a member selected from the group consisting of quaternary ammonium compounds, halogenated compounds, phenolics, alcohols, aldehydes, and mixtures thereof; and (B) a set of instructions associated with the composition which describe a method comprising the step of adding a cleansing and disinfecting amount of a cleansing and disinfecting composition to the garbage disposal in the presence of water and while the grinding action of the garbage disposal is activated to mix the composition and water so that sufficient suds are generated to provide cleansing and disinfecting of the garbage disposal.

11. The product of claim 10 which further comprises a package that contains the composition and wherein the set of instructions are written or printed on the outside of the package.

12. The product of claim 11 wherein the composition comprises from about 0.5% to about 45% of the suds stabilizing surfactant and from about 0.1% to about 25% of the disinfecting agent.

13. The product of claim 12 wherein the composition further comprises from about 5% to about 70% of an additional detergent surfactant selected from the group consisting of anionic surfactants, nonionic surfactants and mixtures thereof.

14. The product of claim 13 wherein the composition further comprises from about 1% to about 15% by weight of a scouring agent.

15. The product of claim 10 wherein the disinfecting agent is selected from the group consisting of hydrogen peroxide, potassium permanganate and mixtures thereof.

16. A method for cleaning and disinfecting a garbage disposal, which comprises the steps of:

(1) providing a flow of water to the garbage disposal;

(2) adding a cleansing and disinfecting amount of a cleansing and disinfecting composition to the garbage disposal in the presence of water and while the grinders of the garbage disposal are activated to mix the composition and water so that suds are generated, the composition being substantially free of a carbon dioxide gas generating reaction system and comprising;

a) a suds stabilizing amount of a suds stabilizing surfactant selected from the group consisting of betaines, ethylene oxide condensates, fatty acid amides, amine oxide, amine oxide semi polar nonionics, sultaines, cationic surfactants and mixtures thereof; and b) a disinfecting amount of a disinfecting agent selected from the group consisting of oxidizing agents and mixtures of oxidizing agents with a member selected from the group consisting of quaternary ammonium compounds, halogenated compounds, phenolics, alcohols, aldehydes, and mixtures thereof;

(3) discontinuing the flow of water to the garbage disposal after the suds are generated; and (4) deactivating the grinder blades of the garbage disposal within about 1 minute after the flow of water is discontinued.

17. The method of claim 16 wherein the grinder blades of the garbage disposal are deactivated during step (4) within about 30 seconds after the flow of water is discontinued.

18. The method of claim 16 wherein the composition comprises from about 1% to about 30% of the suds stabilizing surfactant and from about 0.1% to about 25% of the disinfecting agent.

19. The method of claim 18 wherein the composition further comprises from about 5% to about 70% of an additional detergent surfactant selected from the group consisting of anionic surfactants, nonionic surfactants and mixtures thereof.

20. The method of claim 19 wherein the composition further comprises from about 1% to about 15% by weight of a scouring agent.

* * * * *